US009205656B2

(12) United States Patent
Wada

(10) Patent No.: US 9,205,656 B2
(45) Date of Patent: Dec. 8, 2015

(54) INKJET RECORDING APPARATUS

(75) Inventor: Itaru Wada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/110,788

(22) Filed: May 18, 2011

(65) Prior Publication Data

US 2011/0292118 A1 Dec. 1, 2011

(30) Foreign Application Priority Data

May 27, 2010 (JP) ..... 2010-121659

(51) Int. Cl.
*B41J 2/165* (2006.01)
*B41J 2/17* (2006.01)

(52) U.S. Cl.
CPC ..... *B41J 2/1721* (2013.01); *B41J 2002/1742* (2013.01)

(58) Field of Classification Search
None
See application file for complete search history.

(56) References Cited

U.S. PATENT DOCUMENTS

2002/0041303 A1* 4/2002 Yoshinaga ..... 347/22

FOREIGN PATENT DOCUMENTS

JP 2005-219434 A 8/2005
JP 2006-231612 A 9/2006

* cited by examiner

*Primary Examiner* — Alejandero Valencia
(74) *Attorney, Agent, or Firm* — Canon USA, Inc., IP Division

(57) ABSTRACT

An inkjet recording apparatus includes a carriage configured to hold a recording head having a plurality of discharge ports from each of which ink is discharged, and to move in a first direction, and a platen configured to support a sheet moving downstream in a second direction intersecting with the first direction. The platen has a receiver configured to receive ink discharged towards an outside of the sheet, and a hole provided in an inside of the receiver to suction air therefrom. The hole is provided at a position at which an airflow is generated in a vicinity of a sheet edge so that each record band formed on a sheet with ink discharged from the plurality of discharge ports by movement of the carriage is expanded to at least one of an upstream side and a downstream side in the second direction.

3 Claims, 17 Drawing Sheets

INKJET RECORDING APPARATUS

BACKGROUND OF THE INVENTION

1. Field of the Invention

The present invention relates to an inkjet recording apparatus for discharging ink onto a sheet serving as a recording material to record an image thereon. More particularly, the present invention relates to a structure of an ink receiver provided on a platen to receive ink discharged onto a border portion of a sheet serving as a recording material.

2. Description of the Related Art

In inkjet recording apparatuses, recording of an image without generating a margin at an end portion of a sheet (i.e., borderless recording) is realized by recording an image whose size is larger than that of the sheet. Thus, an ink receiver (i.e., a borderless recording groove) used exclusively for borderless-recording of an image is provided at a position corresponding to an edge of each area of a sheet size on a sheet supporting platen to prevent the platen from being stained by ink running off the sheet (see Japanese Patent Application Laid-Open No. 2006-231612). An inkjet recording apparatus is known, which is configured such that a hole for suctioning ink (i.e., a borderless recording groove suction hole) is provided in the borderless recording groove. The borderless recording groove suction hole assumes a role of attracting a sheet to the platen by generating a negative pressure.

It is known that in such an inkjet recording apparatus, an impact position of ink discharged in a vicinity of a sheet edge is shifted along a suction airflow under influence of a negative pressure generated when ink is suctioned by the borderless recording groove suction hole. In the inkjet recording apparatus, an image is formed by repetition of a set of a recording operation and a sheet-conveying operation. Due to the shift of the impact position of ink, a white streak (white dropout) is generated on a boundary part between recording areas (hereinafter referred to as record bands), each of which is recorded by a recording head at each single scan, on a sheet edge portion.

FIG. 14 is an enlarged view illustrating a configuration of a borderless recording groove 116 provided on a platen 102. As illustrated in FIG. 14, the center in a nozzle port arrangement direction of each nozzle row (discharge-port row) 119, which is arranged in a recording head 107 and is composed of a plurality of nozzles (discharge ports), is located on a straight-line L1 extending in a main scanning direction along which a carriage moves. A borderless recording groove suction hole 117 is provided on the straight-line L1. In the vicinity of a sheet edge, ink discharged from the nozzles of the nozzle row 119 is affected by an airflow generated due to suction by the borderless recording groove suction hole 117. Thus, as illustrated in FIG. 15, shift of the impact position of ink in each of directions respectively indicated by arrows towards the borderless recording groove suction hole 117 along the airflow is caused. Dashed-line circles (white circles) indicate ideal impact positions of ink. Filled circles (black circles) indicate actual impact positions of ink. FIGS. 16A through 16C are schematic views illustrating a mechanism of occurrence of a white streak by focusing attention on formation of a boundary part between record bands in a recording operation. As illustrated in FIG. 16A, ink discharged from the most-upstream one of nozzles of each nozzle row impacts at a position located on a line d2, which is shifted by a suction airflow from an ideal impact position located on a line d1. It is known that at that time, an amount of shift of the impact position in a sheet conveying direction (i.e., a distance between the lines d1 and d2) is 10 micrometers (μm) if a volume flow rate of the airflow from the borderless recording groove suction hole 117 is $1\times10^{-4}$ $m^3$/seconds (s) and the diameter of each ink droplet is 20 μm. The larger the airflow, and the smaller the ink droplet, the larger the amount of shift of the impact position of ink.

Upon completion of an operation of recording one line, a sheet conveying operation is performed. Then, an operation of recording the next line is performed. As illustrated in FIG. 16B, an ink droplet discharged from the most-downstream one of nozzles of each nozzle row impacts at a position located on a line d4, which is shifted by a suction airflow from an ideal impact position located on a line d3. Accordingly, as illustrated in FIG. 16C, no ink impacts on a boundary part between the record bands. Thus, a white streak is generated thereon. That is, if a set of a recording operation and a sheet conveying operation is repeated, as illustrated in FIG. 17, an image is formed, in which a white streak S1 is generated in each boundary part between record bands in an associated recording operation. In addition, a white streak generated at each boundary part between record bands in the vicinity of the sheet edge can be more noticeable, depending upon variation of a sheet conveying operation.

The above problems occur when ink is discharged in the vicinity of the sheet edge, regardless of which of the borderless recording and bordered recording the inkjet recording apparatus performs. The mechanism of occurrence of a white streak has been described in the case of recording of each line by performing what is called single-pass feed of a sheet. However, even if each line is recorded by performing what is called multi-pass feed of a sheet, white streaks occur similarly. The amount of the shift of the impact position of ink due to the suction airflow can be reduced by lowering a suction force of suctioning air from the borderless recording groove suction hole. However, in this case, there is possibility of occurrence of other problems such as stain on the rear surface of a sheet due to record mist, sheet floatation due to reduction in the suction force, and clogging of the hole due to viscosified ink.

SUMMARY OF THE INVENTION

The present invention is directed to an inkjet recording apparatus capable of reducing white streaks occurring on a sheet edge portion.

According to an aspect of the present invention, an inkjet recording apparatus includes a carriage configured to hold a recording head having a plurality of discharge ports from each of which ink is discharged, and to move in a first direction, and a platen configured to support, at a position at which recording is performed by the recording head, a sheet moving downstream in a second direction intersecting with the first direction. The platen has a receiver configured to receive ink discharged towards an outside of the sheet, and a hole provided in an inside of the receiver to suction air therefrom. The hole is provided at a position at which an airflow is generated in a vicinity of a sheet edge so that each record band formed on a sheet with ink discharged from the plurality of discharge ports by movement of the carriage is expanded to at least one of an upstream side and a downstream side in the second direction.

According to an exemplary embodiment of the present invention, white streaks occurring on a sheet edge portion can be reduced by shifting an impact position of ink discharged from one end portion in a direction of arranging nozzles of each nozzle row and that of ink discharged from the other end portion in such a direction in which the impact position of ink discharged from the one end portion of each nozzle row corresponding to each record band and that of ink discharged from the other end portion of each nozzle row corresponding to another record band adjacent thereto approach each other on the associated boundary part between the record bands.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
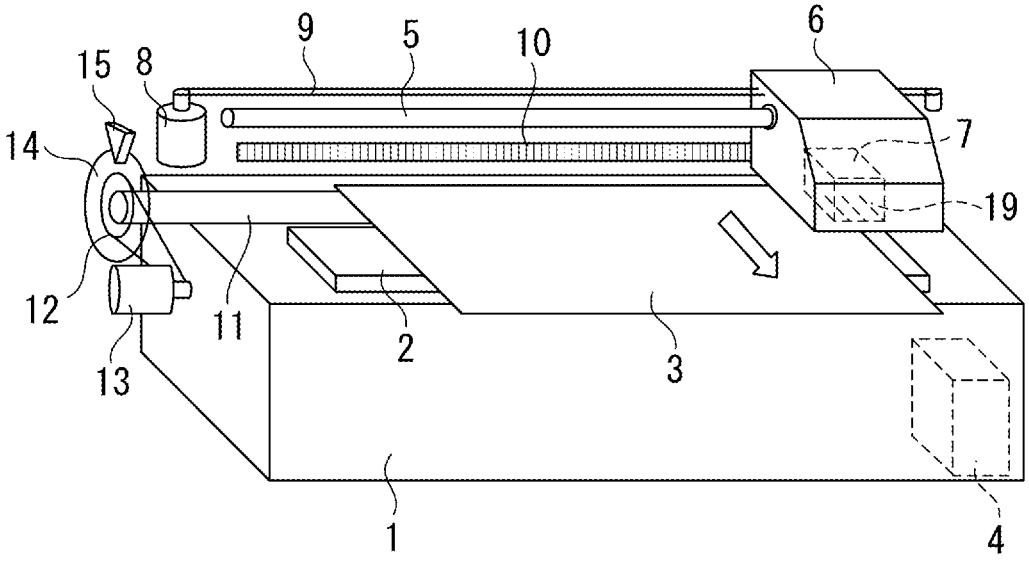
FIG. 1 is a perspective view illustrating a primary part of an inkjet recording apparatus according to an exemplary embodiment of the present invention.

FIG. 1 is a perspective view illustrating a primary part of an inkjet recording apparatus according to a first exemplary embodiment of the present invention. A casing 1 is provided in the inkjet recording apparatus. A platen 2 is arranged on the casing 1. A suction device 4 for suctioning, to the platen 2, a sheet 3 serving as a recording medium is provided in the casing 1. A carriage 6 configured to reciprocate in a main scanning direction (first direction) is supported on a main rail 5 installed to extend in a longitudinal direction of the casing 1. An inkjet type recording head 7 is mounted on the carriage 6. Recording heads of various inkjet types such as a type using heating-elements, that using piezoelectric elements, that using electrostatic-actuators, and that using micro-electro-mechanical system (MEMS) devices can be employed as the recording head 7. The recording head 7 has a plurality of nozzle rows 19 in each of which a plurality of nozzles (discharge ports) for discharging ink are arranged. Accordingly, the platen 2 is arranged at a position facing the plurality of nozzle rows 19 of the recording head 7.

A carriage motor 8 is a drive source for moving the carriage 6 in the main scanning direction perpendicular to a sub-scanning direction (second direction (i.e., a direction of an arrow illustrated in FIG. 1)) in which a plurality of nozzles of each nozzle row 19 are arranged. A rotary drive force of the carriage motor 8 is transmitted to the carriage 6 by a belt 9. A position in the main scanning direction of the carriage 6 is detected by a linear encoder, and monitored. The linear encoder has a linear encoder pattern 10 attached to the casing 1, and a reading unit (not shown) mounted on the carriage 6 to read the encoder pattern 10 optically, magnetically, or mechanically. The sheet 3 serving as a recording material moved with respect to the recording head 7 is conveyed on the platen 2 in the sub-scanning direction perpendicular to the main scanning direction of the carriage 6. The conveying operation is performed by a drive mechanism having a conveyance roller 11, a belt 12, and a conveyance motor 13. A driving state (represented by e.g., a rotational amount, and a rotational speed) of the conveyance roller 11 is detected by a rotary encoder, and monitored. The rotary encoder has an encoder pattern 14 provided to extend in a circumferential direction of a circular disc rotating together with the conveyance roller 11, and a reading unit 15 for reading the encoder pattern 14 optically, magnetically or mechanically.

Figure 2:
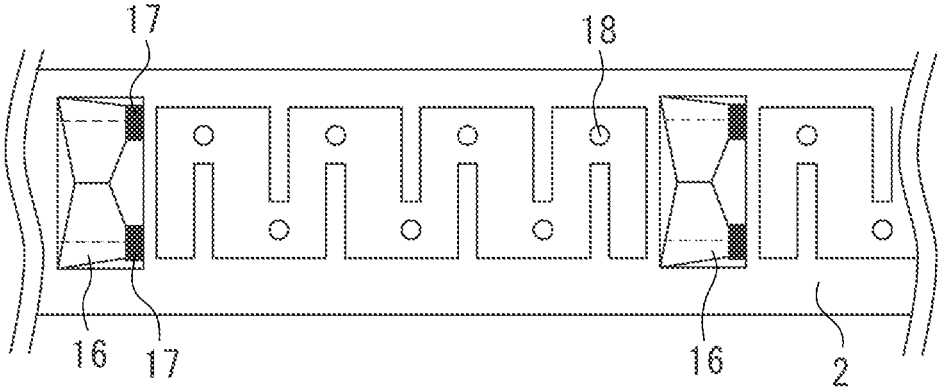
FIG. 2 is a plan view illustrating a platen.

FIG. 2 is a plan view illustrating the platen 2, which is taken from above. A plurality of suction holes 18, from which air is suctioned to attract the sheet 3 onto the platen 2, are provided on the platen 2. Borderless recording grooves 16 serving as receivers are provided on the platen 2, which receive ink discharged from the recording head 7 when the inkjet recording apparatus performs borderless recording to discharge ink onto an edge portion of the sheet 3 of an appropriate-size enabled to perform borderless recording. The borderless recording grooves 16 are provided at positions respectively corresponding to edge portions of the sheet 3 of appropriate-sizes enabled to perform borderless recording. Two borderless recording groove suction holes 17 serving as holes for suctioning ink discharged onto the platen 2 to appropriately process the suctioned ink as waste liquid are provided in each of the borderless recording grooves 16. In addition, the borderless recording groove suction holes 17 serve to process the ink as waste liquid, and to suction air to attract the sheet 3 onto the platen 2.

Figure 3:
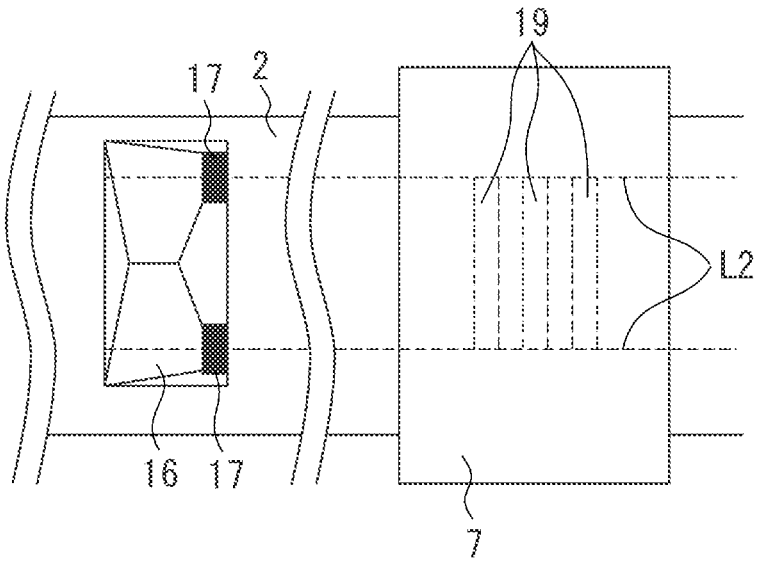
FIG. 3 is a plan view illustrating a configuration of a borderless recording groove.
Figure 4:
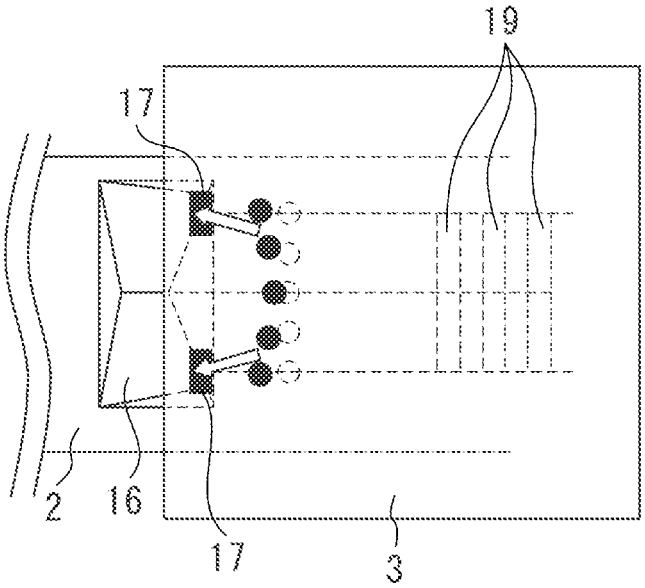
FIG. 4 is a schematic view illustrating shift of an impact position of ink.
Figures 5A, 5B, 5C:
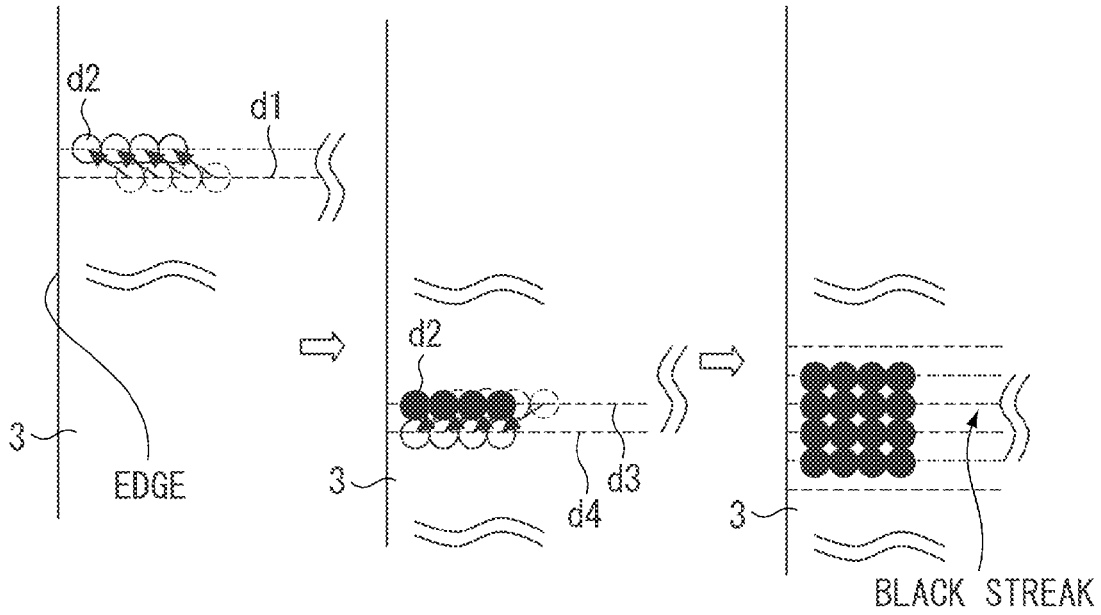
FIGS. 5A through 5C are schematic views illustrating a mechanism of reducing white streaks generated on a sheet edge portion.
Figure 6:
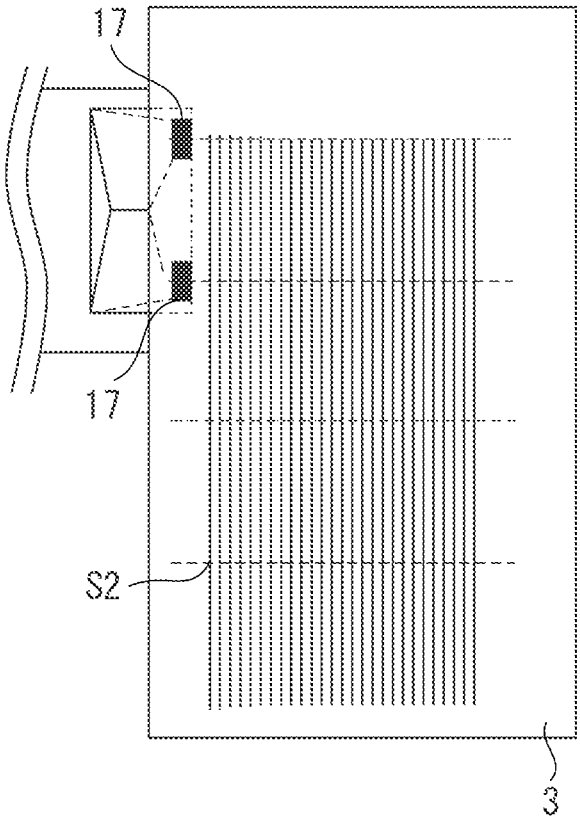
FIG. 6 is a plan view illustrating a state in which an image reduced in white streaks generated on a sheet edge portion is formed.

FIG. 3 is a plan view illustrating a configuration of a borderless recording groove according to the present exemplary embodiment. As illustrated in FIG. 3, the two borderless recording suction holes 17 are located on two straight-lines L2 extending in the main scanning direction, on which both end portions (i.e., an upstream end portion and a downstream end portion in the direction of conveying the sheet 3) are moved together with the carriage 6 in a direction of arranging the plurality of nozzles of each nozzle row 19. In the vicinity of the edge portion of the sheet 3, ink discharged from the nozzles of each nozzle row 19 is affected by airflow due to suction from the borderless recording groove suction holes 17. Thus, as illustrated in FIG. 4, shift of an impact position of ink in the direction of the along the airflow occurs. In FIG. 4, dashed-line circles (white circles) indicate ideal impact positions of ink. Filled circles (black circles) indicate actual impact positions of ink. FIGS. 5A, 5B, and 5C are schematic views illustrating a mechanism of reducing white streaks according to the present exemplary embodiment, by focusing attention on formation of a boundary part between record bands in a recording operation. As illustrated in FIG. 5A, the impact position of ink discharged from the end portion (hereinafter referred to as the most-upstream end portion of each nozzle row) located at an up-stream side in the direction of conveying the sheet 3 is shifted by the suction airflow from an ideal impact position line d1. Thus, the ink impacts at positions located on a line d2. After an operation of recording one line, an operation of conveying the sheet 3 is performed. Then, an operation of recording the next line is performed. On the other hand, as illustrated in FIG. 5B, the impact position of ink discharged from the end portion (hereinafter referred to as the most-downstream end portion of each nozzle row) located at a down-stream side in the direction of conveying the sheet 3 is shifted from an ideal impact position line d3. Thus, the ink impacts at positions located on a line d4. Accordingly, as illustrated in FIG. 5C, the impact position of ink is shifted in such a direction that ink impacted on an associated boundary part between record bands from the most-upstream end portion of each nozzle row corresponding to one of the record bands overlaps with that impacted thereon from the most-downstream end portion of each nozzle row corresponding to the other record band. Thus, a black streak is generated on the boundary part between the record bands. That is, when a set of a recording operation and a sheet-conveying operation is repeated, as illustrated in FIG. 6, an image is formed, in which a black streak S2 is generated corresponding to the boundary part between each pair of the adjacent record bands.

According to a human visual sense, an image having black streaks is estimated to be better in image quality than that having white streaks. According to the present exemplary embodiment, white streaks generated in an image are reduced to thereby enhance image quality.

Figure 7:
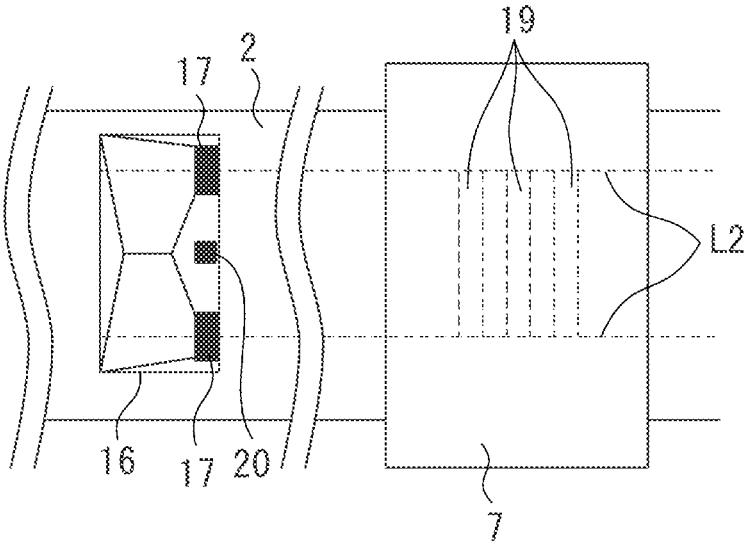
FIG. 7 is a plan view illustrating a configuration of a borderless recording groove.

It is advisable to arrange a suction hole (e.g., a borderless recording groove suction hole 20), at which a suction force is smaller than that at the borderless recording groove holes 17, in each borderless recording groove hole 17, as illustrated in FIG. 7. In this case, an airflow is generated, which flows towards the borderless recording groove suction holes 17 at which a suction force is large. Consequently, advantages similar to those of the above exemplary embodiment can be obtained.

Figure 8:
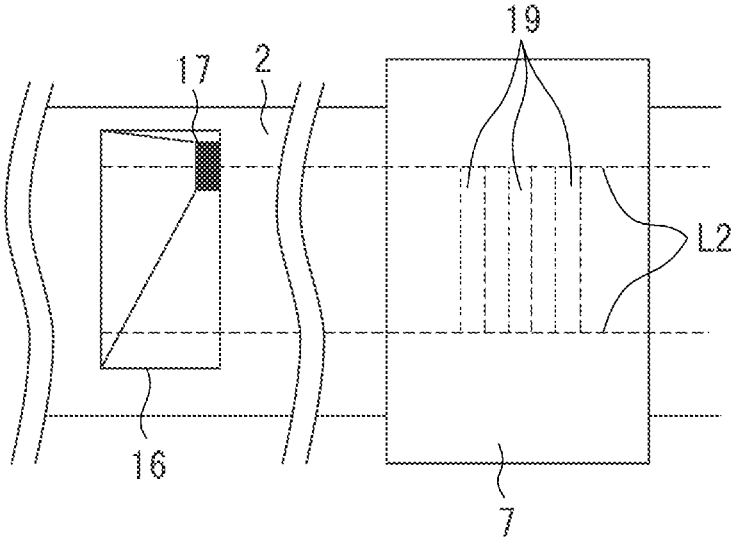
FIG. 8 is a plan view illustrating another configuration of a borderless recording groove.
Figure 9:
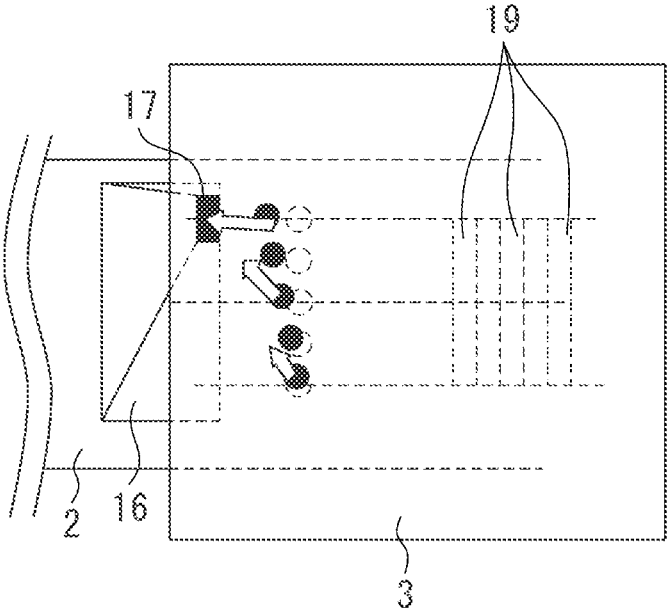
FIG. 9 is a schematic view illustrating shift of an impact position of ink.
Figures 10A, 10B, 10C:
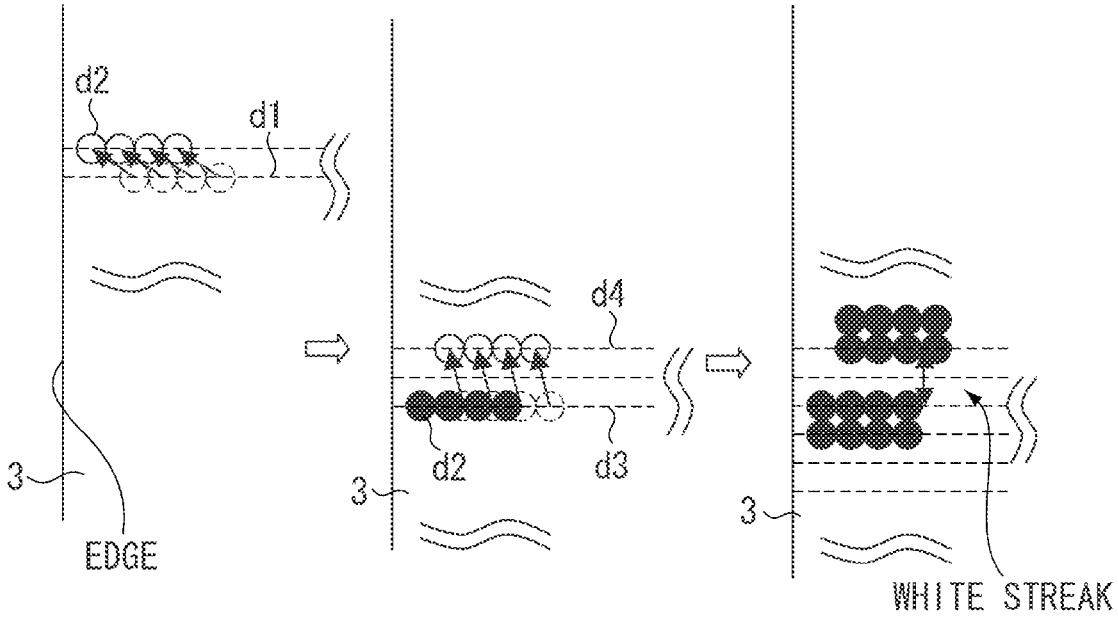
FIGS. 10A through 10C are schematic views illustrating a mechanism of reducing white streaks generated on a sheet edge portion.
Figures 16A, 16B, 16C:
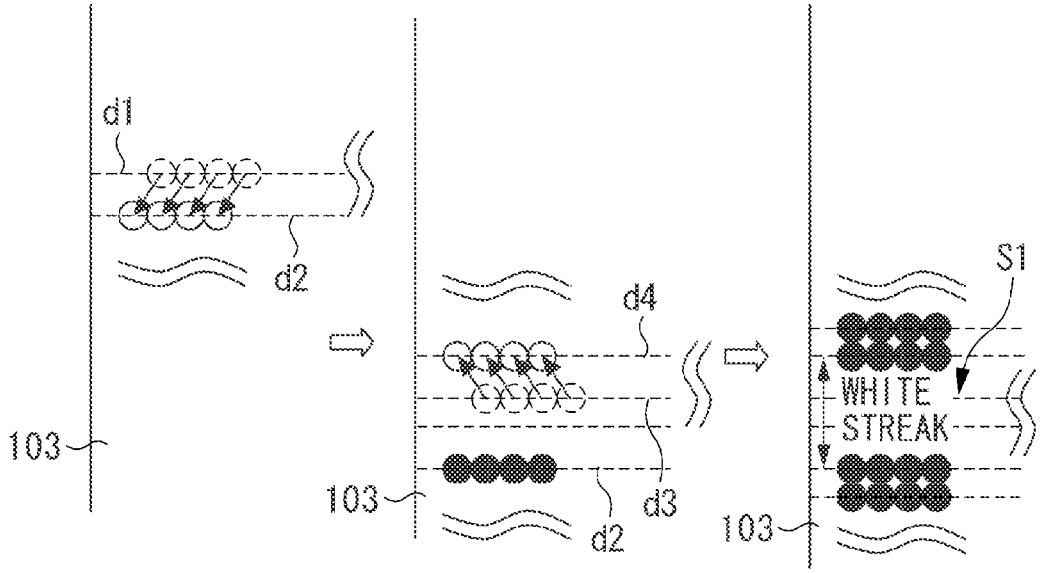
FIGS. 16A through 16C are schematic views illustrating a mechanism of occurrence of white streaks on a sheet edge portion.
Figure 17:
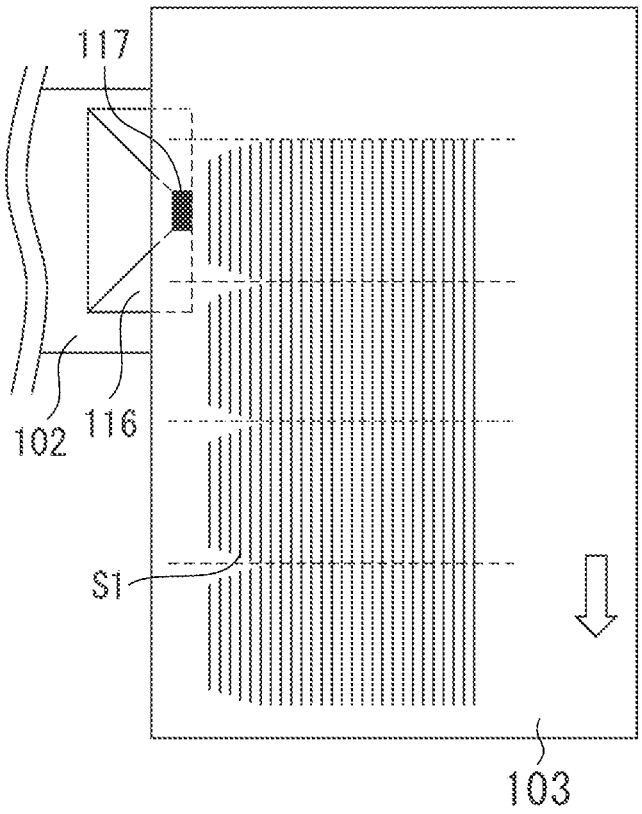
FIG. 17 is a plan view illustrating an image in which white streaks occur on a sheet edge portion.

Even if the borderless recording groove suction hole 17 is provided in only one of both end portions in the direction of arranging a plurality of nozzles of each nozzle row 19, as illustrated in FIG. 8, the inject recording apparatus according to the present exemplary embodiment can obtain the advantage in reducing white streaks. In this case, shift of the impact position of ink in the direction of each borderless recording groove suction hole 17 (i.e., the direction of an arrow) along the airflow occurs, as illustrated in FIG. 9. In FIG. 9, white circles indicate ideal impact positions of ink. Black circles indicate actual impact positions. Focusing attention on the boundary part between the record bands, the impact position of ink discharged from the most-upstream end portion of each nozzle row is shifted by the suction airflow from the ideal impact position line d1. Thus, the ink impacts at positions located on a line d2, as illustrated in FIG. 10A. After an operation of recording one line, a sheet-conveying operation of conveying the sheet 3 is performed. Then, in an operation of recording the next line, the impact position of ink discharged from the most-downstream end portion of each nozzle row is shifted from an ideal impact position line d3. Thus, the ink discharged from the most-downstream end portion of each nozzle row impacts at positions located on a line d4, as illustrated in FIG. 10B. Accordingly, as illustrated in FIG. 10C, white streaks generated on an edge portion of the sheet 3 can be reduced, as compared with the state described in the description of the related art with reference to FIG. 16C.

Next, a second exemplary embodiment of the present invention is described hereinafter with reference to the drawings. A configuration of an inkjet recording apparatus according to the second exemplary embodiment is similar to that of the inkjet recording apparatus according to the above first exemplary embodiment. Thus, description of components common to the first exemplary embodiment and the second exemplary embodiment is omitted.

Figure 11:
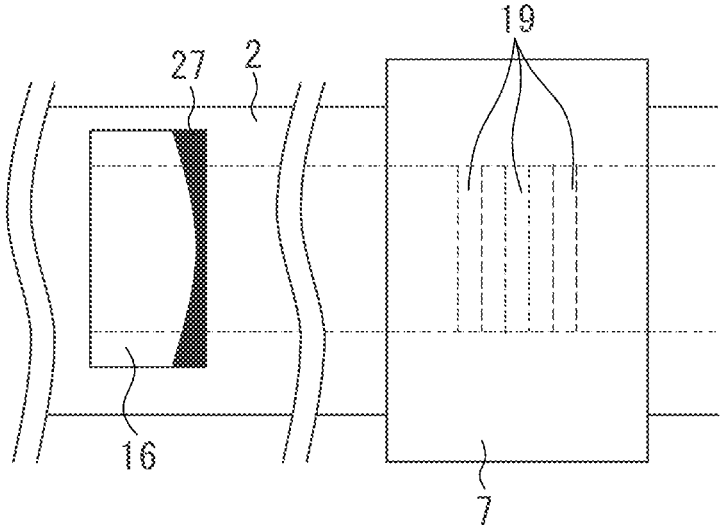
FIG. 11 is a plan view illustrating a configuration of a borderless recording groove.

FIG. 11 is a plan view illustrating a borderless suction hole 27 according to the present exemplary embodiment. As illustrated in FIG. 11, the borderless recording groove suction hole 27 is formed as a slit-like hole which is longer than a length in the direction of arranging nozzles in each nozzle row in the recording head 7. The borderless recording groove suction hole 27 is formed into a shape in which an opening cross-sectional area thereof gradually or stepwise increases towards both end portions thereof from the center in the direction of arranging the nozzles of each nozzle row, and that the opening cross-sectional area thereof gradually or stepwise increases towards an edge portion of the sheet 3.

Figure 12:
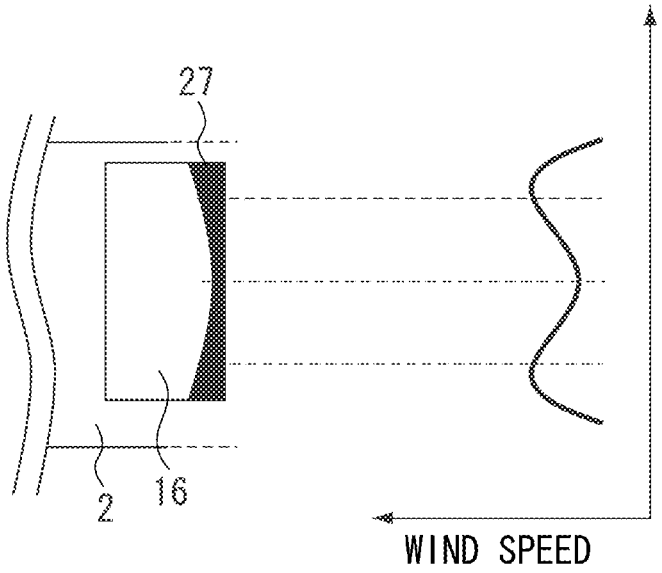
FIG. 12 is a schematic view illustrating a wind speed distribution in addition to a configuration of a borderless recording groove.
Figure 13:
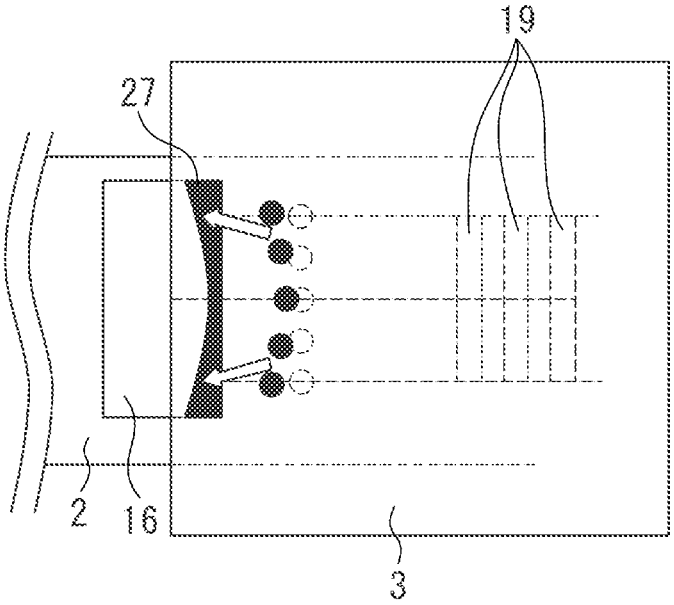
FIG. 13 is a schematic view illustrating shift of an impact position of ink.
Figure 14:
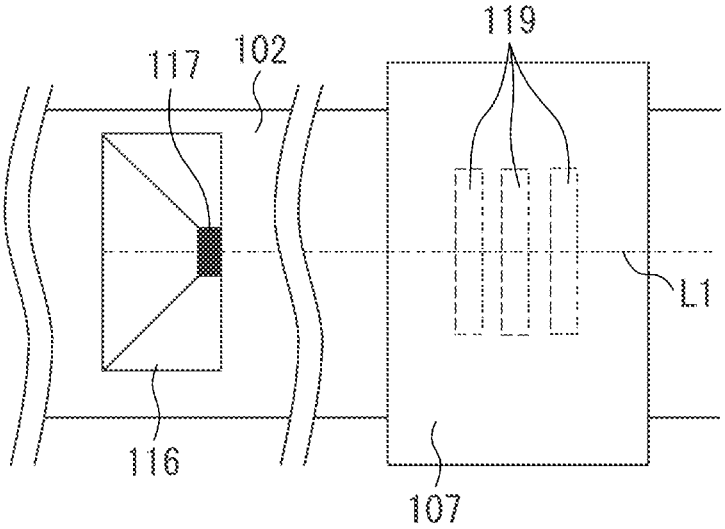
FIG. 14 is a plan view illustrating a configuration of a borderless recording groove which a platen has.
Figure 15:
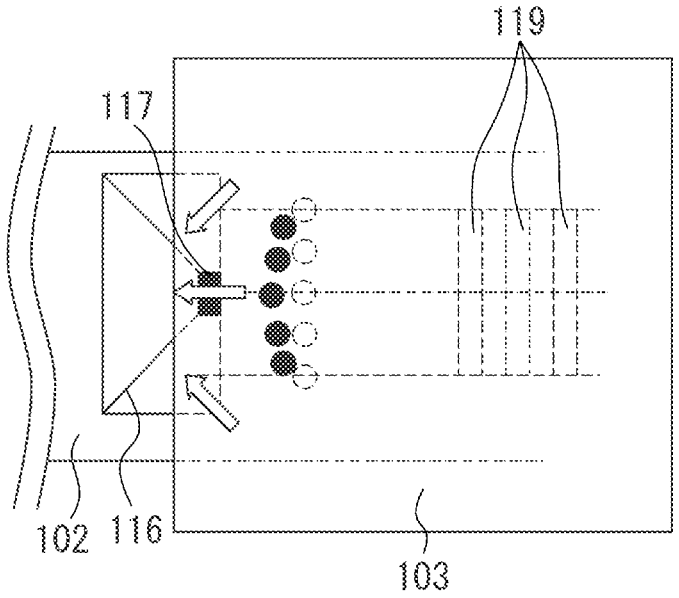
FIG. 15 is a plan view schematically illustrating shift of an impact position of ink.

At that time, a distribution of a wind-speed of wind generated by the borderless recording groove suction hole 27 is caused, as illustrated in FIG. 12. Accordingly, ink discharged from the nozzles of each nozzle row 19 is affected by airflow due to suction from the borderless recording groove suction hole 27. The ink operates such that shift of the impact position of the ink in the direction of the borderless recording groove suction hole (i.e., the direction of an arrow) occurs, as illustrated in FIG. 13. In FIG. 13, white circles indicate ideal impact positions of ink. Black circles indicate actual impact positions thereof. Even in the present exemplary embodiment, a black streak is generated between the record bands as illustrated in FIG. 5C.

As described above, according to the first exemplary embodiment and the second exemplary embodiment, the impact position of the ink discharged from the most-upstream end portion of each nozzle row 19 corresponding to each record band is shifted in a direction towards that of the ink discharged from the most-downstream end portion of each nozzle row 19 corresponding to the adjacent upstream-side record band. On the other hand, the impact position of the ink discharged from the most-downstream end portion of each nozzle row 19 corresponding to each record band is shifted in a direction towards that of the ink discharged from the most-upstream end portion of each nozzle row 19 corresponding to the adjacent downstream-side record band. That is, each of the impact position of the ink discharged from the most-upstream end portion of each nozzle row 19 corresponding to each record band and that of the ink discharged from the most-downstream end portion of each nozzle row 19 corresponding thereto is shifted on an associated boundary part between record bands in a direction in which a black streak whose visual recording quality is good is generated. In other words, the impact position of the ink discharged from each of the most-upstream end portion and the most-downstream end portion of each nozzle row 19 corresponding to each record band is shifted in a direction in which an end portion in the direction of conveying the sheet 3 of each record band overlaps with that in the direction of conveying the sheet 3 of a record band adjacent thereto. Accordingly, the inkjet recording apparatus according to the present exemplary embodiment can reduce white streaks generated on edge portions of the sheet 3.

Although the present invention relates to a structure of each borderless recording groove provided on a platen, similar advantages can be obtained even if an air suction hole 18 provided on a platen in an inkjet printer provided with no borderless recording groove has a configuration similar to that of the suction hole according to the above exemplary embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-121659 filed May 27, 2010, which is hereby incorporated by reference herein in its entirety.

What is claimed is:

1. An inkjet recording apparatus comprising:

a recording head having a plurality of discharge ports aligned in a row for discharging ink;

a carriage configured to mount the recording head thereon and to move in a first direction;

a platen having suction holes to support a recording medium which is conveyed in a second direction intersecting the first direction; and an ink receiving portion having a recessed receiving part provided on the platen configured to receive ink when the recording head positions above an end of the recording medium for borderless printing, and to suck ink received on the recessed receiving part through a plurality of openings embedded in the recessed receiving part and arranged along the second direction, wherein the openings consist of a first opening facing the center of the rows of discharge ports, a second opening facing one end of the rows of discharge ports, and a third opening facing another end of rows of the discharge ports when the recording head positions above the ink receiving portion, and no other opening except the first, the second and the third openings is embedded in the recessed receiving part, and wherein the second and the third openings are larger than the first opening.

2. The inkjet recording apparatus according to claim 1, wherein the hole is a slit whose length in the second direction is larger than that of a row of a plurality of discharge ports arranged in the second direction, and wherein the slit is formed such that a slit width in the first direction thereof gradually or stepwise increases towards at least one of end portions in the second direction thereof from the center in the second direction of the plurality of discharge ports.

3. The inkjet recording apparatus according to claim 1, wherein the hole is a slit whose length in the second direction is larger than that of each row of a plurality of discharge ports, and wherein the slit is formed such that a slit width in the first direction thereof gradually or stepwise increases towards at least one of end portions in the second direction thereof from the center in the second direction of the plurality of discharge ports.

* * * * *